US008746488B2

(12) United States Patent
Caunter et al.

(10) Patent No.: US 8,746,488 B2
(45) Date of Patent: Jun. 10, 2014

(54) PACKAGING CAN AND METHOD AND APPARATUS FOR ITS MANUFACTURE

(75) Inventors: Nicholas James Caunter, Maidenhead (GB); Tanya Ruth Gledhill, Abingdon (GB); Ian Maxwell, Reading (GB); Maurice Riviere, Bois d'Arcy (FR)

(73) Assignee: Crown Packaging Technology, Inc., Alsip, IL (US)

( * ) Notice: Subject to any disclaimer, the term of this patent is extended or adjusted under 35 U.S.C. 154(b) by 1232 days.

(21) Appl. No.: 11/885,542

(22) PCT Filed: Feb. 20, 2006

(86) PCT No.: PCT/EP2006/060094

§ 371 (c)(1),
(2), (4) Date: Jun. 9, 2008

(87) PCT Pub. No.: WO2006/092364

PCT Pub. Date: Sep. 8, 2006

(65) Prior Publication Data

US 2009/0022861 A1 Jan. 22, 2009

(30) Foreign Application Priority Data

Mar. 1, 2005 (EP) ..... 05101552
May 11, 2005 (FR) ..... 05 04741

(51) Int. Cl.

| | |
|---|---|
| ***B65D 1/40*** | (2006.01) |
| ***B65D 3/22*** | (2006.01) |
| ***B65D 6/14*** | (2006.01) |
| ***B65D 8/04*** | (2006.01) |
| ***B65D 90/02*** | (2006.01) |
| ***B65D 41/00*** | (2006.01) |
| ***B65D 1/42*** | (2006.01) |
| ***C08G 59/42*** | (2006.01) |

(52) U.S. Cl.
USPC ..... 220/359.3; 220/62.11; 220/359.4; 220/657; 426/131

(58) Field of Classification Search
USPC ..... 220/359.3, 62.11, 359.4, 657; 426/131
See application file for complete search history.

(56) References Cited

U.S. PATENT DOCUMENTS

| | | | |
|---|---|---|---|
| 3,709,398 | A | 1/1973 | Fuhrmann |
| 4,366,662 | A | 1/1983 | Katsura et al. |
| 4,447,184 | A | 5/1984 | Buri et al. |
| 4,744,484 | A | 5/1988 | Grabher |

(Continued)

FOREIGN PATENT DOCUMENTS

| | | | |
|---|---|---|---|
| DE | 1922678 | A1 | 11/1970 |
| DE | 8129904 | U1 | 3/1983 |

(Continued)

*Primary Examiner* — Fenn Mathew
*Assistant Examiner* — Andrew T Kirsch
(74) *Attorney, Agent, or Firm* — Baker & Hostetler LLP

(57) ABSTRACT

A can for packaging food, comprising a metal can body and a diaphragm lid (16) formed of lidding material which comprises a multilayer structure with at least an aluminum layer of from 6 to 90 microns thickness and a bond layer for fixing the lid (16) directly to the can body. One method for forming the can forms the lidding material by using an outwardly extending curl (20) at one end of the metal can body as the draw die. Lidding material which is carried by the body maker punch is drawn around the curl of the can body draw die so as to form the lidding material into a cup shape.

21 Claims, 9 Drawing Sheets

(56) References Cited

U.S. PATENT DOCUMENTS

| | | | | | |
|---|---|---|---|---|---|
| 4,890,759 | A | | 1/1990 | Scanga et al. | |
| 4,961,513 | A | * | 10/1990 | Gossedge et al. | 220/276 |
| 5,911,334 | A | * | 6/1999 | Helms | 220/359.4 |
| 5,913,798 | A | | 6/1999 | Grabher | |
| 5,996,835 | A | * | 12/1999 | Farrington et al. | 220/613 |
| 6,036,043 | A | * | 3/2000 | Erfgen et al. | 220/270 |
| 2001/0023870 | A1 | * | 9/2001 | Mihalov et al. | 220/359.3 |
| 2002/0003143 | A1 | * | 1/2002 | Grayer | 220/359.2 |
| 2002/0034649 | A1 | | 3/2002 | Le Du et al. | |

FOREIGN PATENT DOCUMENTS

| | | | |
|---|---|---|---|
| DE | 29817592 | U1 | 11/1998 |
| EP | 0209031 | A1 | 1/1987 |
| EP | 0683110 | A1 | 11/1995 |
| FR | 2810014 | A1 | 12/2001 |
| WO | 96/31406 | A1 | 10/1996 |

* cited by examiner

PACKAGING CAN AND METHOD AND APPARATUS FOR ITS MANUFACTURE

This invention relates to a can for packaging foodstuffs and a method and apparatus for forming such a can. The invention also relates to the forming of lidding materials for fixing to metal packaging such as metal cans.

In particular, but not exclusively, it relates to the packaging of solid food, for people or pets. Such cans will also be referred to hereinafter as "food cans".

BACKGROUND ART

Metal packaging is known in which a can body having a metal ring seamed to one end of the can body supports a peelable lid which comprises a multi-layer membrane having typically a peelable polypropylene layer, a layer of aluminium, and an outer layer of print, lacquer, PET or other coating. The material of the lidding material is generally chosen according to the requirements dictated by the product with which the can body is filled. For example, there is a need for maintaining seal integrity during processing, sterilisation etc. of food products but the lid must also be capable of being readily opened for access to the food for consumption.

The use of an intermediate metal ring to support the lidding material is usual for optimum seal integrity. However, the production of this ring leads to substantial wastage of material since the central part of the ring cannot economically be re-used for conventional can component sizes. In addition, the ring may reduce access to the can contents. Manufacturing time using separate stages for manufacturing the ring and fixing the lidding material to this ring is also long. There is therefore a need to provide a container in which the lid is bonded directly to the can body, thereby obviating the need for an intermediate component. Manufacture of the packaging can of the invention is also simplified so as to reduce manufacturing costs, whilst facilitating access to the contents of the finished can.

EP-0819086 describes a process for manufacturing a can with a foil membrane, in which the membrane is preformed with a raised edge and is inserted into the can so that the outside edge region is raised in the direction of the can axis. The edge is then connected to the inside of the can wall by an adhesive bond or heat seal. This process is inherently slow because not only does the foil membrane require preforming but careful handling is needed for location in the can body. The can body also has to be removed from the can making line or pass through one or more separate stations for pressing the membrane onto can body wall.

DISCLOSURE OF INVENTION

According to the present invention, there is provided a can for packaging food, comprising: a metal can body having an access opening; and a lid for closing the access opening, the lid being fixed directly to the can body; characterised in that the lid is formed of lidding material which comprises a multilayer structure with at least an aluminium layer of from 6 to 90 microns thickness and a bond layer.

Typically, the bond layer of the lidding material is of polypropylene or a modified polypropylene. The can body may be formed from a metal sheet which is coated with a lacquer having polypropylene dispersed in the lacquer. The sheet may then be formed by welding, for example, into a cylinder to provide the can body. The side seam thus formed is generally separately coated with a similar internal lacquer or with a polypropylene powder. Alternatively, the plate could be coated with a conventional lacquer and a specific lacquer, such as one including a dispersion lacquer, used only for coating that part of the can wall and weld which is to contact the foil lidding material.

In one embodiment, the lid may also include an integral tab which may be folded back onto the lid and, optionally, at least partly fixed to the lid, for example by heat sealing or fusion of material so as to keep the tab folded back onto the lid.

The lid may be fixed by tightly heat sealing for fusion of the lidding material directly onto the can body sidewall. Inclining the sealing surface at an angle ensures that opening of the closed container is not entirely in shear mode as would happen when the sealing surface is vertical and the pull is vertical. By increasing the sealing surface angle, the container has been found to be easier to open without risking tearing off the tab, even if the customer pulls vertically.

A further advantage of the inclined sealing surface is that the incidence of wrinkles in the lidding material is reduced adjacent the can sidewall and localised peel from the can sidewall is eliminated.

In one embodiment of the invention, the sealing surface may be inclined at angles ranging from 20° to 150° to the vertical. Angles of above 90° are preferred for containers in which the lidding material is deflected in order to control in-can pressure during processing of the food product in the container. So-called barometric ends can be used for processing in, for example, reel and spiral retorts. By increasing the wall angle above 90°, this angle becomes greater than the angle subtended by the extremity of the lidding material in its outwardly domed position. As a result, the bond only undergoes shear loading, which effectively doubles burst pressure performance from that of standard cans which are loaded in peel mode.

Although trials have shown that ease of opening increases as the angle increases, the edge of the sidewall protrudes beyond the main sidewall diameter as the sealing surface is inclined. This can cause problems for handling and stacking. For this reason, 90° angles are avoided and for non-barometric ends, preferred sealing surface angles are from 20° to 60° to the vertical, ideally from 30° to 50°. For barometric ends, preferred sealing surface angles are up to 135° to give sufficient dome size. Thus for ease of opening, angles of from 30° to 135° are preferred, but for handling, angles of substantially 90° tend to be avoided.

Preferably, the sealing surface is an inner surface of the can body which delimits the access opening. In this embodiment, the lid is substantially dish-shaped with a vertical or inclined sidewall according to the sealing surface angle. Alternatively, the sealing surface may be an "outer" surface of the can body which forms part of a peripheral curl bordering the access opening.

Optionally, the tab may extend over the outside of the can body. The lid and tab may comprise non-preformable material.

According to another aspect of the present invention, there is provided a method of manufacturing the above can by directly fixing the lid to the can body, for example by heat sealing or fusion of the lidding material. This method may typically comprise the steps of drawing the lid along a surface which is parallel or inclined at an angle to the can body centre axis; and sealing the lid directly to this surface. Alternatively, the method may comprise applying a part of the lid against a peripheral curl of the can body bordering the access opening; and drawing the lid along the surface while moving the lid in sliding support on the curl.

When the lid includes an integral tab, the method may include folding back the tab onto the lid either prior to or simultaneously with or after fixing the lid to the can body.

According to a still further aspect of the present invention, there is provided a method for forming a lidding material, the method comprising: supporting a lidding material on a punch;

forming a metal can body having an outwardly extending curl at one end; supporting the opposite end of the can body on a base support; moving the can body and punch relative to each other; and drawing the lidding material which is carried by the punch around the curl of the can body so as to form the lidding material into a cup shape.

By drawing the lidding material around the can body and using the can body as a forming die, the lidding material can be both formed and held within the can body at a single station for fixing to the inner sidewall of the can body.

The step of moving the can body and punch relative to each other may be achieved by pushing the can body with the base support while the punch is moved into the can body, or holding the punch stationary while the can body is moved axially over the punch, or a combination of these.

According to a further aspect of the present invention, there is provided an apparatus for forming a lidding material, the apparatus comprising: a metal can body having an outwardly extending curl at one end; a base support for supporting the opposite end of the can body; and a punch; in which the can body acts as a forming die so that lidding material which is carried by the punch is formed into a cup shape by drawing around the curl of the can body.

The apparatus may also include an ejector die surrounding the punch so that relative movement between the ejector die and the can body releases the punch from the can body after forming of the lidding material. The ejector die may be surrounded by a locator die for holding the lidding material in position on the punch, prior to and during forming.

Preferably, the base support acts as a pusher, but in an alternative embodiment the punch could act as a pusher if the can is held stationary. Clearly it is also possible for both the base support and the punch to act as pushers, although this is less practical.

The base support may comprise a plate with a central mandrel extending from the plate into the can body. If the can body is flanged, then this flange may be located against the base support plate. The diameter of the central mandrel is selected for ease of sliding into the can body with a small clearance.

Ideally, the punch has an end portion which extends axially at least 2 mm. This end portion carries the lidding material as it forms around the can body so that the diameter of the punch end portion needs to be an interference fit or only sufficiently less than the can body inner wall and the thickness of the lidding material such that the cup shape formed by the lidding material is held for bonding against the can body sidewall without damaging the lidding material or base flange. The seal length may be greater than 2 mm, for example around 2.5 mm. The punch internal diameter may be slightly greater than the can internal diameter so as to stretch the can body in an interference fit to assist in providing pressure across the seal and create a good bond.

The apparatus preferably further includes an induction heater coil which surrounds the can body or is within the punch when the punch is holding the cup of lidding material against the can body inner wall. The base support, punch and other apparatus components other than the can body may be made of metals with low electrical conductivity, polymeric, glass or ceramic material so that the induction heater only induces heat in the can body and lidding material for bonding the lidding material to the can body inner wall.

BRIEF DESCRIPTION OF DRAWINGS

Preferred embodiments of the invention will now be described, by way of example only, with reference to the drawings, in which.

MODE(S) FOR CARRYING OUT THE INVENTION

Figure 1:
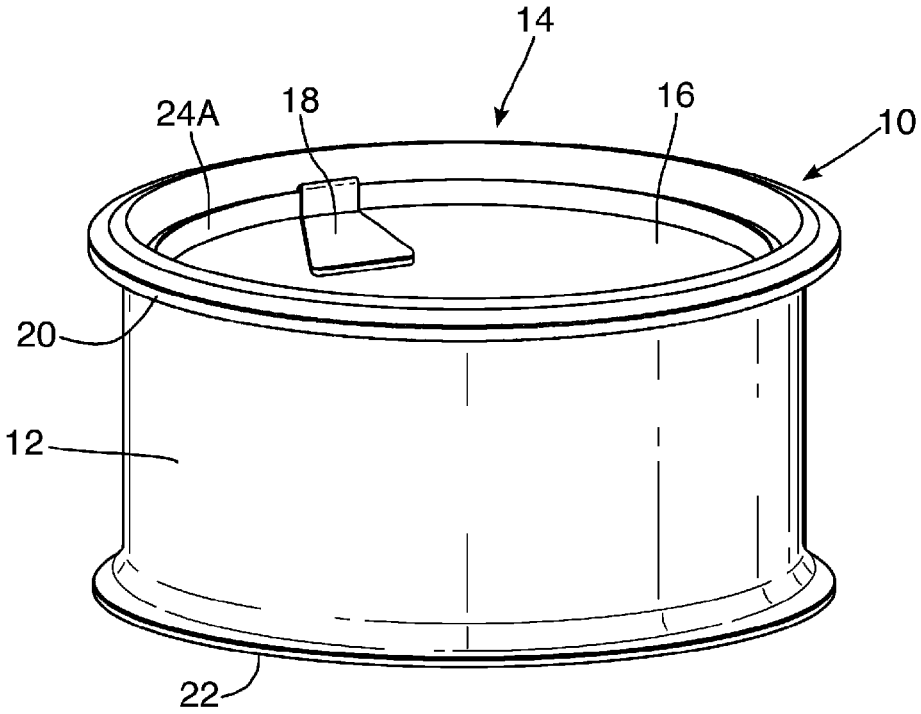
FIG. 1 is a perspective view of a food can according to a first embodiment of the invention.

FIG. 1 shows a can for packaging foodstuffs, designated by the general reference 10. The food can 10 comprises a metal can body 12 having an access opening 14, a lid 16 (also referred to as foil or lidding material) for closing the access opening 14 and an opening tab 18. The tab 18 shown in FIG. 1 is integral (a single piece) with the lid 16 and projects over the edge of the latter and is folded back onto this lid. Optionally, of course, the tab 18 could be made from a separate piece of material and fixed to the lid 16 in any desired position.

The metal can body 12 is generally cylindrical, having a circular cross-section. The can body 12 thus comprises two extremities. A first extremity forms a peripheral curl 20 which is shaped like a tubular ring ("toric" shape) and borders the access opening 14. The other extremity has a flare 22, on a level with the second extremity, designed to receive a conventional can end (not shown).

The lid 16 is sealed directly onto the can body 12, to an upper part 24A of an inner surface of the can body, adjacent the curl 20. This inner surface 24A delimits the access opening 14 and, in this embodiment, is substantially perpendicular to the plane of the access opening 14. The lid 16 is sealed onto the can body 12 by a tight circumferential seam 26 obtained by fusion (heat sealing) of its material.

The tab 18 of this example is sealed at its base 18A onto the lid 16 in such a way as to keep it folded back onto the lid. The base 18A of the tab 18 corresponds to the part of the tab extending from the junction with the lid 16 along the sealed part of the lid.

The tab 18 is sealed to the lid 16 by fusion of material. More precisely, in the example shown in FIGS. 1 and 2, the outer face of the lid 16 in relation to the can body 12, as well as the face of the tab 18 opposite the lid in folded-back position, are covered by a film which is heat-sealable onto itself, for example of the polyethylene terephthalate (PET) type. The lid 16 and the tab 18 can comprise a non-preformable material;

for example, mainly based on polypropylene (pp). This material may in particular have the following composition: 9 microns aluminium, 12 microns nylon (OPA) and 50 to 80 microns polypropylene. As a variant, the lid 16 and tab 18 comprise a preformable material; for example, based on aluminium.

A process for manufacturing the can 10 of FIGS. 1 and 2 will now be described. With reference to FIG. 3, after having folded back the tab 18 onto the lid 16, the lid is positioned so that the tab is under the lid and the lid rests on a support 28. The support comprises a fixed disc 30 surrounded by a cylinder 32 which is slidable coaxially relative to the disc 30 and returnable elastically upwards to a position in which its upper annular face 33 is coplanar with that of the disc 30.

The can body 12 is then brought close to the lid 16 so as to apply the peripheral curl 20 against a part of this lid 16. The relative centring of the can body 12 with the lid 16 is ensured by a sleeve 34 for centring the can body relative to the lid's support 28. The periphery of the lid 16 is thus pinched between the curl 20 and the upper annular face 33 of the sliding cylinder 32.

The descent of the can body 12 then brings about the downward sliding of the cylinder 32. The disc 30 then draws the lid 16 along the inner surface 24, the lid being moved in sliding support between the curl 20 and the face 33 of the sliding cylinder 32. At the end of the drawing process, the lid is released from this sliding support and takes the form of a dish with a flat bottom 16A and substantially cylindrical sidewall 16B.

Figure 4:
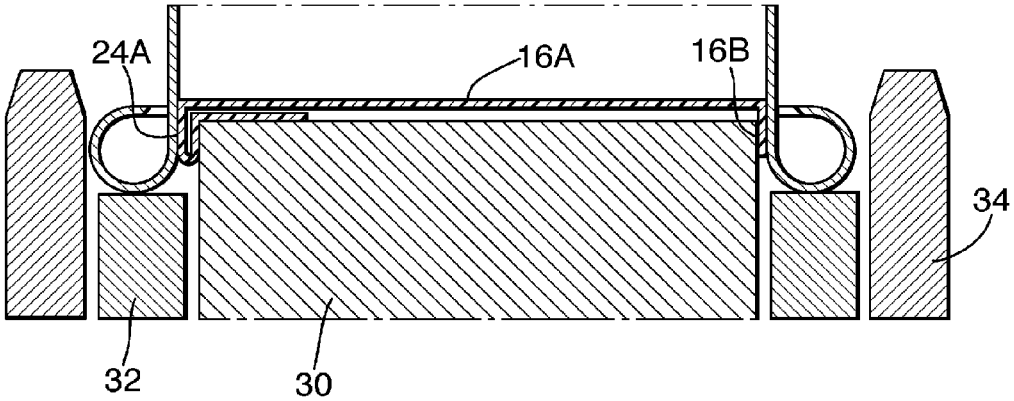

One thus obtains the drawn configuration represented in FIG. 4. While keeping this configuration, the parts of the lid 16 in contact with the upper part 24A of the inner surface 24 are then heated, typically by induction heating either externally to the can upper sidewall or within the dish of the foil lid, so as to seal this lid onto the can body 12 by fusion of its material. The residual heat being diffused in the lid 16 at the same time may be used to seal the tab 18 onto the lid 16 so that two bonds are realised in a single operation. However, it is not always necessary or even desirable to seal the tab onto the can body.

In the following figures, the elements analogous to those of the first embodiment are designated by identical references.

Figure 5:
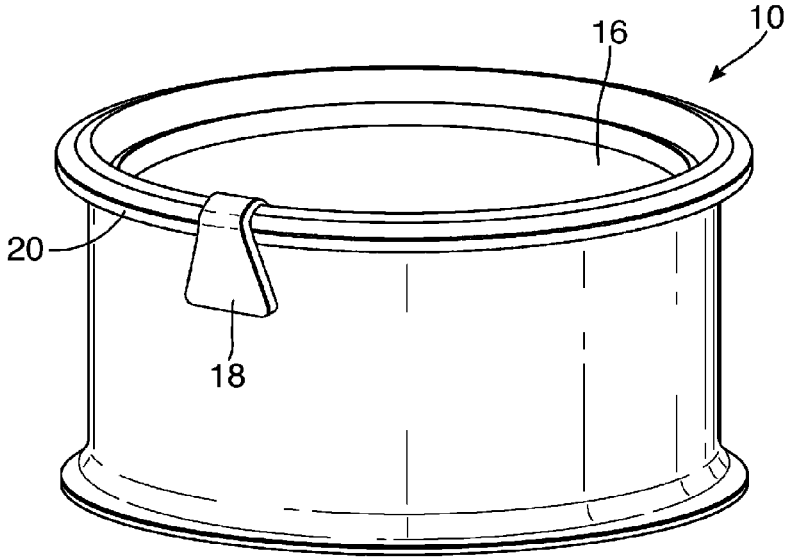
FIGS. 5, 6, 7 and 8 are views analogous to those of FIGS. 1 to 4, according to a second embodiment of the invention.
Figure 6:
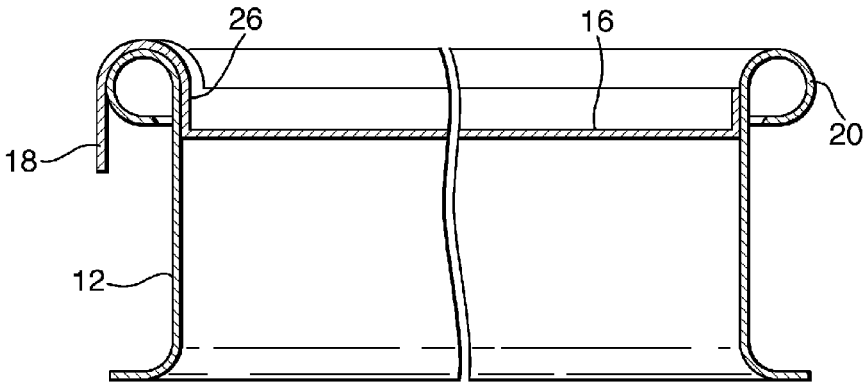
Figure 7:
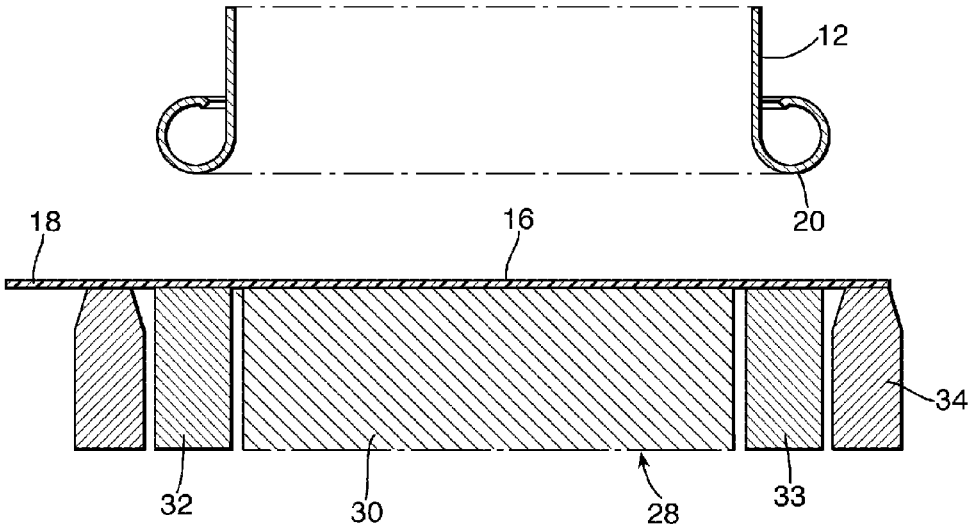
Figure 8:
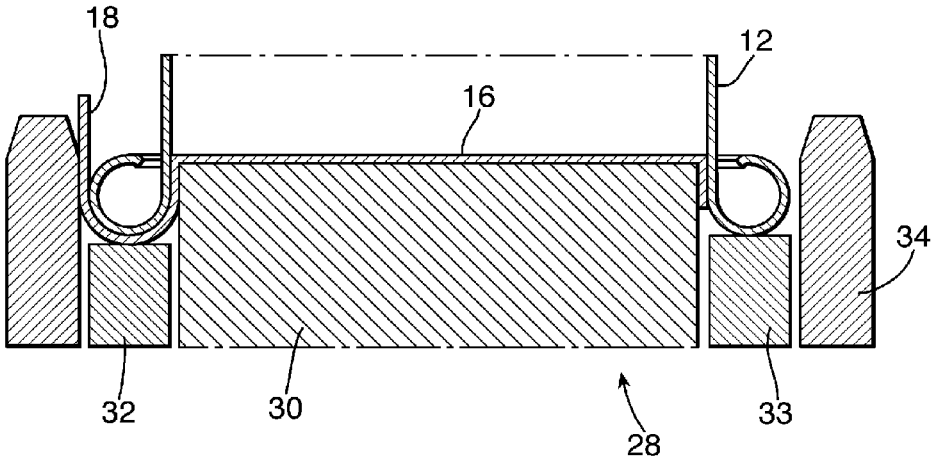

FIGS. 5 and 6 represent a second embodiment of the invention. This embodiment differs from the previous one in that the tab 18 extends over the outside of the can body 12. The manufacturing process of this embodiment is represented in FIGS. 7 and 8. Unlike the process of FIGS. 3 and 4, the lid 16 is centred on the support 28 with the tab folded back. During the stage of drawing the lid 16, the centring sleeve 34 allows the tab 18 to be guided in such a way that it extends along the can body 12.

Figure 9:
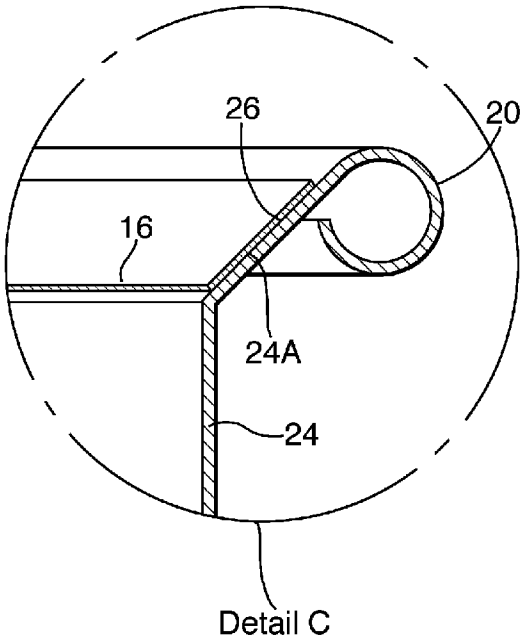
FIG. 9 is a side sectional view of a third embodiment of the invention—a food can—which has an angled sealing surface.
Figure 9:
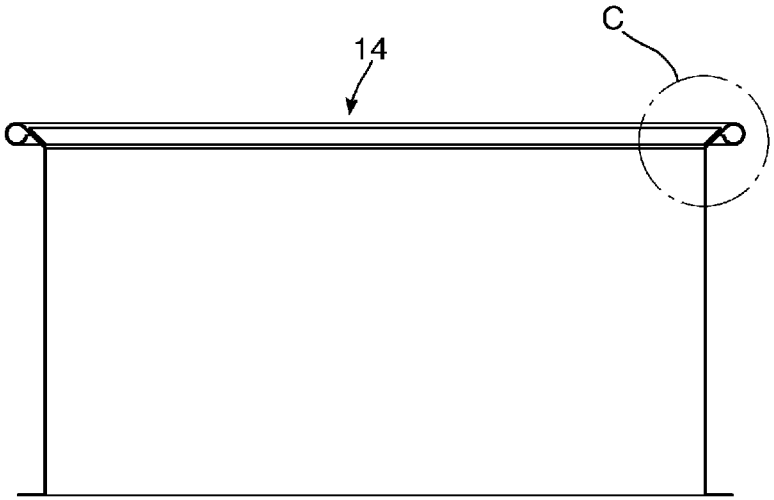

FIG. 9 shows a third embodiment of the invention, in which the sealing surface 24A is inclined at an angle of 45°. The tab 18 in its folded and unfolded positions corresponds to that shown in FIGS. 1 and 5 respectively. The tab 18 could be pre-folded and then the lidding material placed on the punch 30 (see FIGS. 10 and 11). Alternatively, the punch 30 could be allowed to fold the tab, although care is then required to avoid the tab 18 bonding to the top of the curl of the can body.

Figure 2:
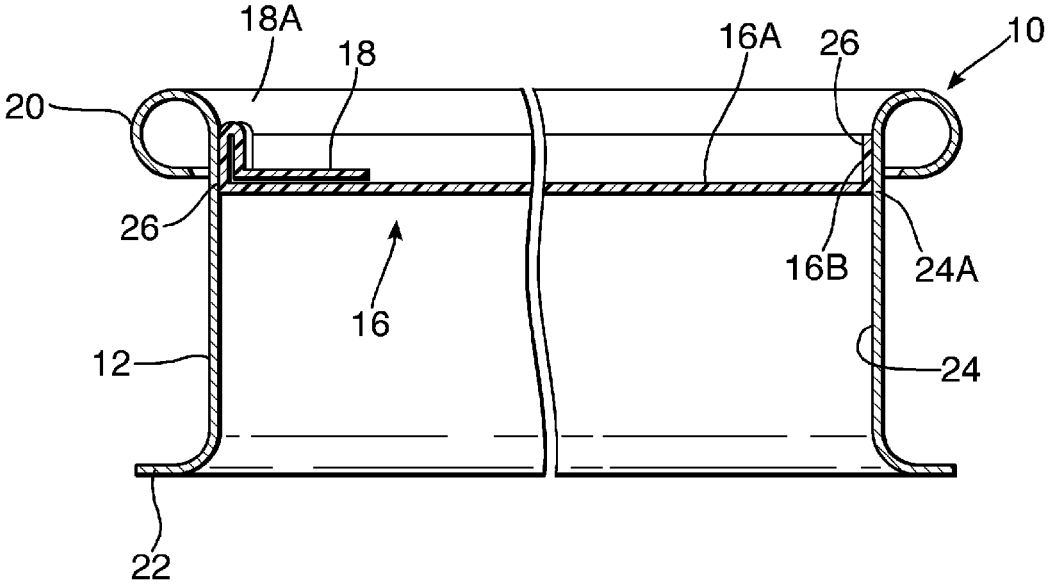
FIG. 2 is a side view of the can of FIG. 1.
Figure 3:
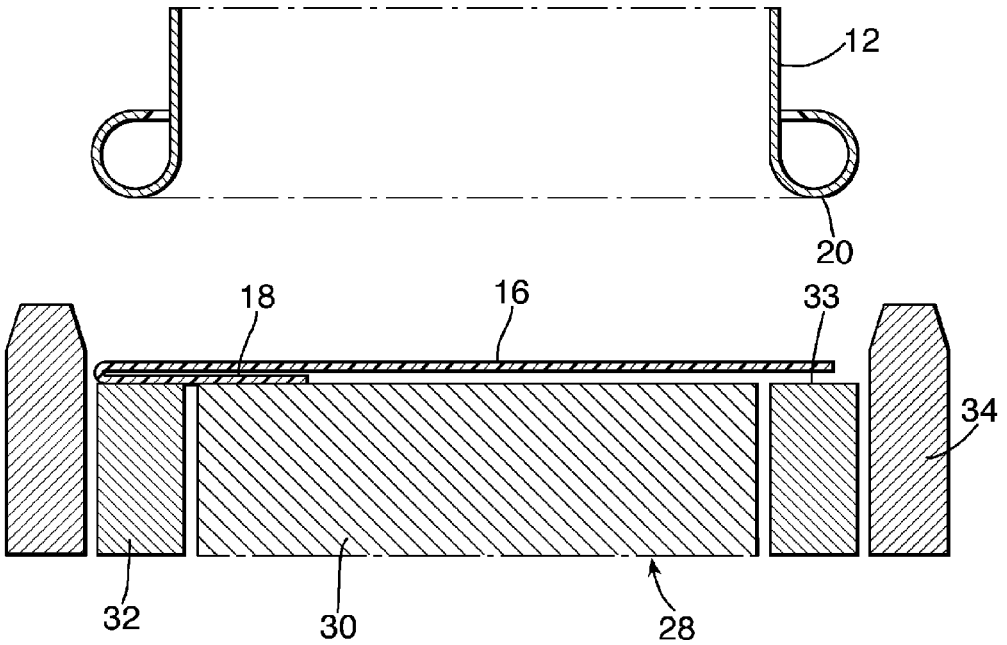
FIGS. 3 and 4 are side views of the can body and lid of FIGS. 1 and 2 during manufacture.

In a small scale trial, the embodiments of FIG. 2 (vertical seal) and FIG. 9 were tested by a random group for openability. The vertical sealing surface 24A of the cans of FIG. 2 was considered by many of the group to be unconventional and so individuals had to decide on a new opening technique. Two separate sample batches of cans according to FIG. 2 were tested by the group. In the first batch, 61% of the tabs stayed attached and 31% of the ends were removed completely. In the second batch, only 17% of tabs stayed attached and 8% of the ends were removed completely. The main problem with the FIG. 2 cans appeared to be that the tab was too tight so that it was hard to pull out and to break the seal with the can body. Careful pulling of the tab at the beginning and end of the opening process was required in order to peel open the whole of lid without risk of tearing.

Figure 10:
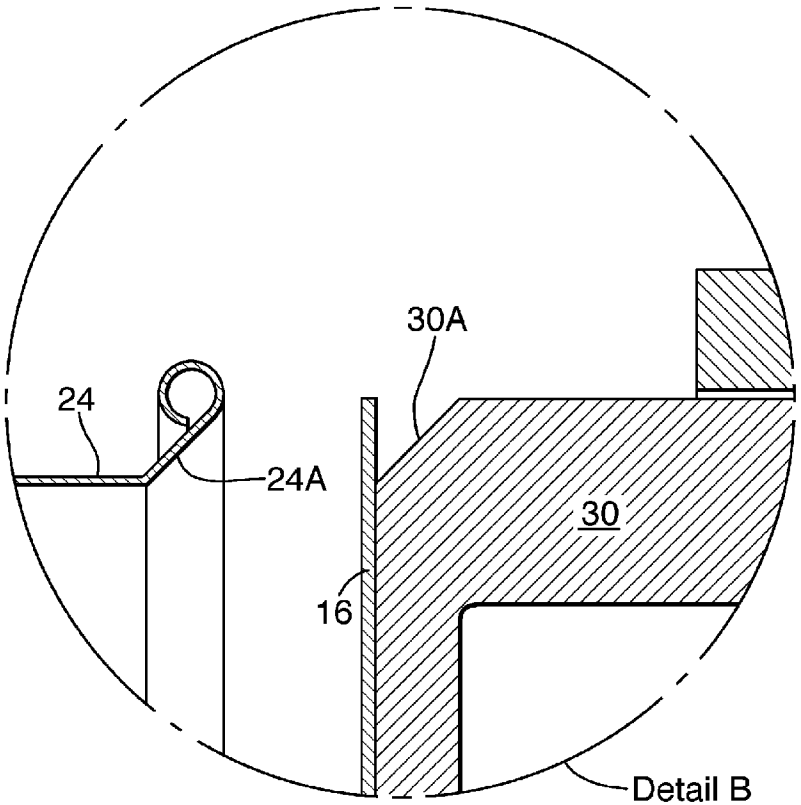
FIGS. 10 and 11 are side views of the can of FIG. 9, showing an apparatus for forming the lidding material before and after forming.
Figure 10:
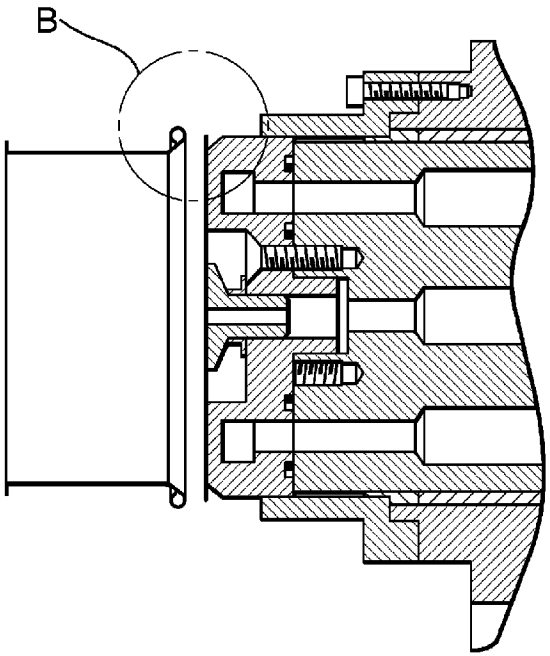
Figure 11:
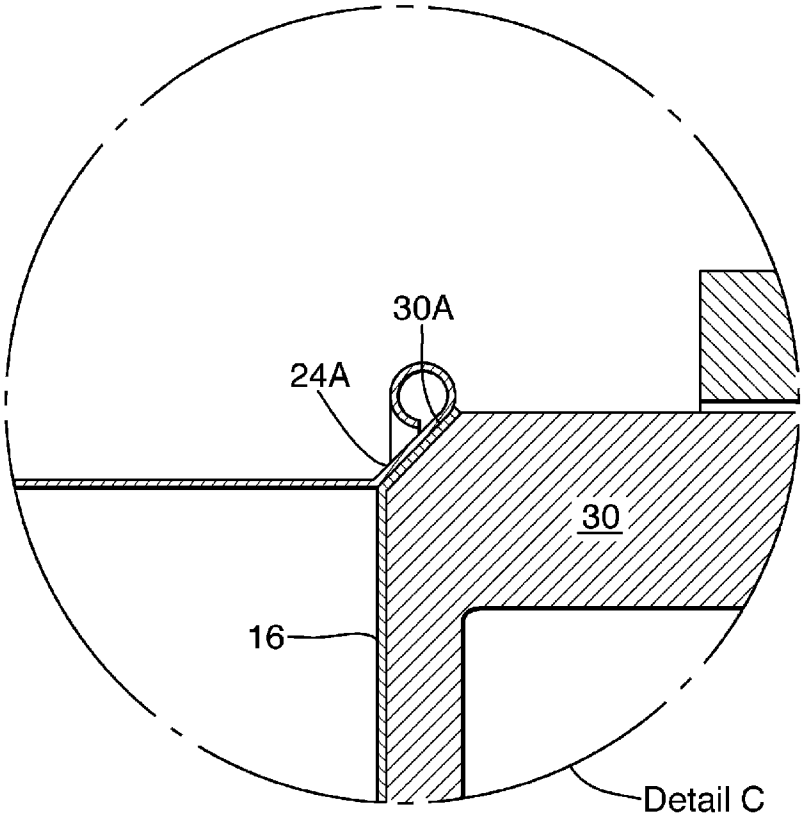
Figure 11:
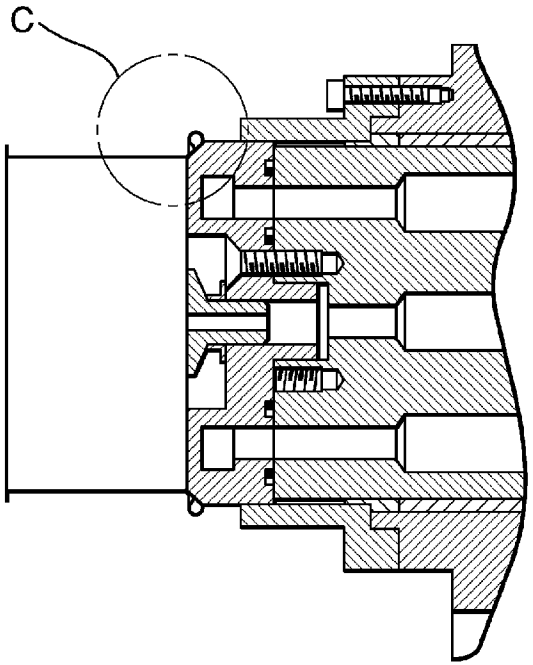

The embodiment of FIG. 9 was also tested for a variety of taper angles, the taper being present on both the sealing surface 24A of the can (FIG. 9) and punch 30A (FIGS. 10 and 11). Cans and punches having tapers of 30°, 40° and 60° were tested. The tab 16 could be pulled and the lidding removed in 100% of the can batches and for all angles tested. Openability was clearly improved with the sealing surface angled outwards as in FIG. 9. It is believed that reducing the angle between the sealing surface 24A and the vertical (direction of tab pull) led to successful opening, even when pulling the tab 18 vertically.

The foil 16 for all embodiments was fixed to the can body 12 by heat sealing. When heating the can using an external induction heater to seal the foil 16 in place, a long delay is necessary to cool the can before the punch 30 can be successfully removed, without dragging the foil out with the punch and degrading the quality of the seal. This can also be improved by using an internal heater radially inboard of the foil 16 and can sidewall 24 so that the can sidewall is not directly adjacent the heater. The foil 16 which is adjacent the heater reduces direct heating of the can body curl 20 which, in turn, may lead to lacquer damage and subsequent rusting of the can body. Furthermore, the tapered can and punch 30 allows the punch to be withdrawn sooner as the foil 16 is not gripped by the punch when tapered.

The rigidity of cans having a taper in the top of the can and top double seam curl and increased can gauge (FIG. 9) was also compared with the straight walled cans (FIG. 2). The straight walled cans 10 of FIG. 2 did not have enough hoop strength to withstand impact before collapsing at a very low height. Gripping of the straight walled cans 10 to open or peel back the foil 16 and transporting on conveyor belts could cause the can to flex inwardly and for product to be forced outwards and spill. The tapered cans of FIG. 9 enabled the cans to be dropped at 0.8 m for a 30° taper, 1.08 m for a 45° taper and 1.23 m for a 60° taper before the foil bursts. When opened by a consumer, tapered wall cans no longer flex inwards.

Cans with a top taper can be stacked without the need for inward necking of the can bottom. The elimination of the neck creates improved axial strength, as well as providing more flat surface area for paper labelling. Straight walled cans 10 of FIG. 2 which had to be necked for stacking caused problems when forming the top curl 20, as the necked-in part requires extra support. Also when induction heating the straight walled can 10, when the clamp pressure is too high the can may crumple if it is slightly out of height specification. This would lead to unacceptable downtime in production lines. The increased top diameter due to the taper in the cans of FIG. 9 allows the bottom of one can to fit snugly into the top of the next can. A 30° taper is a little tight in stacking, 60° is a little loose and around 45° is about ideal.

When the foil 16 is sealed to the can body, the lower the sealing surface 24A angle, the greater the tendency for the foil to wrinkle when sealed and processed with a vacuum (low pressure). A taper of 30° or more reduces this wrinkling to the point of acceptability.

Figure 12:
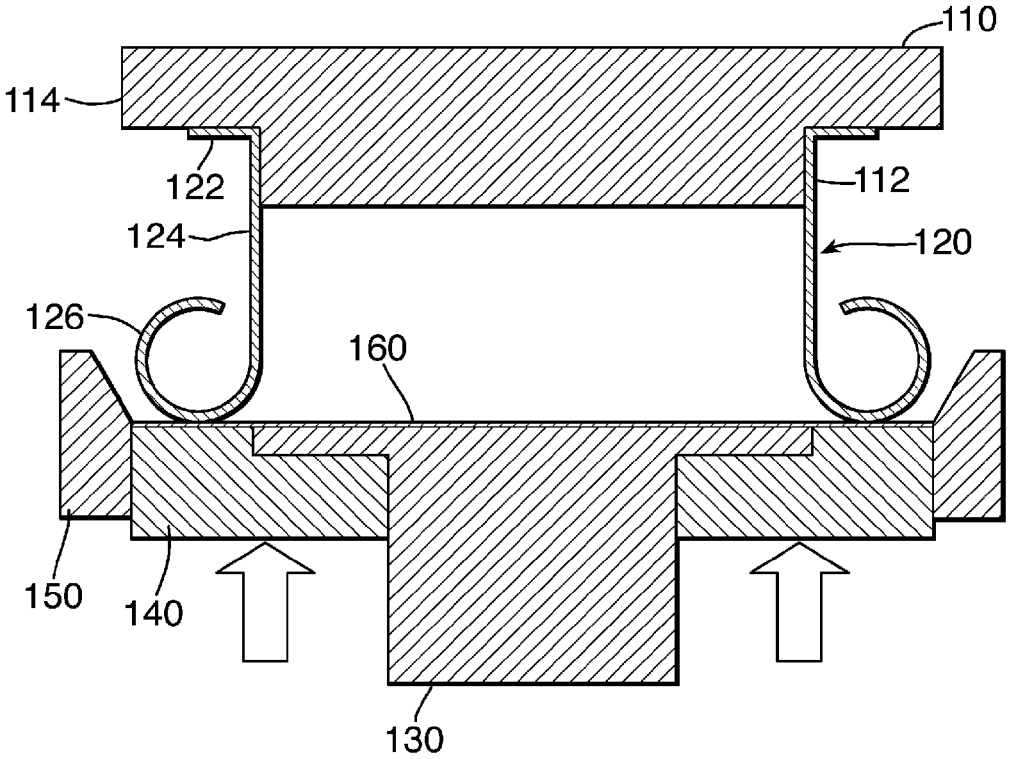
FIG. 12 is a schematic side section of another apparatus for forming the lidding material into a cup.

The apparatus of FIG. 12 shows a base support 110 of polymeric, glass or ceramic material which includes a mandrel portion 112 which enters a can body 120. The can body 120 has been formed in conventional manner for a so-called three piece can, by welding a sheet of lacquered tinplate into a cylinder. A further lacquer layer ("side stripe") is painted, roller coated or sprayed over the welded side seam. Can body 120 is shown in diagrammatic form only and not in any way to scale. The can body 120 is flanged at one end, this end being known as "the filler's end", being the end through which the can body is filled with product. The flange 122 contacts plate 114 of the base support 110. This end may also be necked to reduce the sidewall diameter by typically 1 to 4 mm for improved stackability of the filled and closed container.

At the opposite end, the can body 120 has a curl 126. The lidding material 160 will be fixed to this end prior to filling, as is described in more detail below. A punch 130 surrounded by ejector 140 and foil locator 150 supports lidding material 160 in the start position shown in FIG. 12. The base support 110 is pushed into the open end of the can body 120 with the piston and ejector biased against the curl 126.

The lidding material 160 of the example shown in the figures may be a foil type of lidding or a flexible lidding. One example of a foil lidding material comprises a base layer of peelable polypropylene of about 25 microns thickness, a layer of aluminium of from 40 to 90 microns thickness (typically around 70 microns), and a print, lacquer, PET layer or other coating. Optionally, a thin layer of corrosion resistant lacquer may be provided between the polypropylene layer and the aluminium layer. The polypropylene layer is generally a single layer having about 7 microns of polypropylene which has been modified so as to adhere to the aluminium layer, and about 18 microns of polypropylene modified with polyethylene and/or other materials which is peelable when sealed against polypropylene.

One example of a flexible lidding material comprises a base layer of 25 to 100 microns or more of polypropylene, which has been modified to be peelable, 6 to 40 microns of aluminium, and 12 to 25 microns of polyethylene terephthalate (PET).

Another example is to use the same lidding material, but with 15 to 30 microns of a nylon between the polypropylene and the aluminium.

Figure 13:
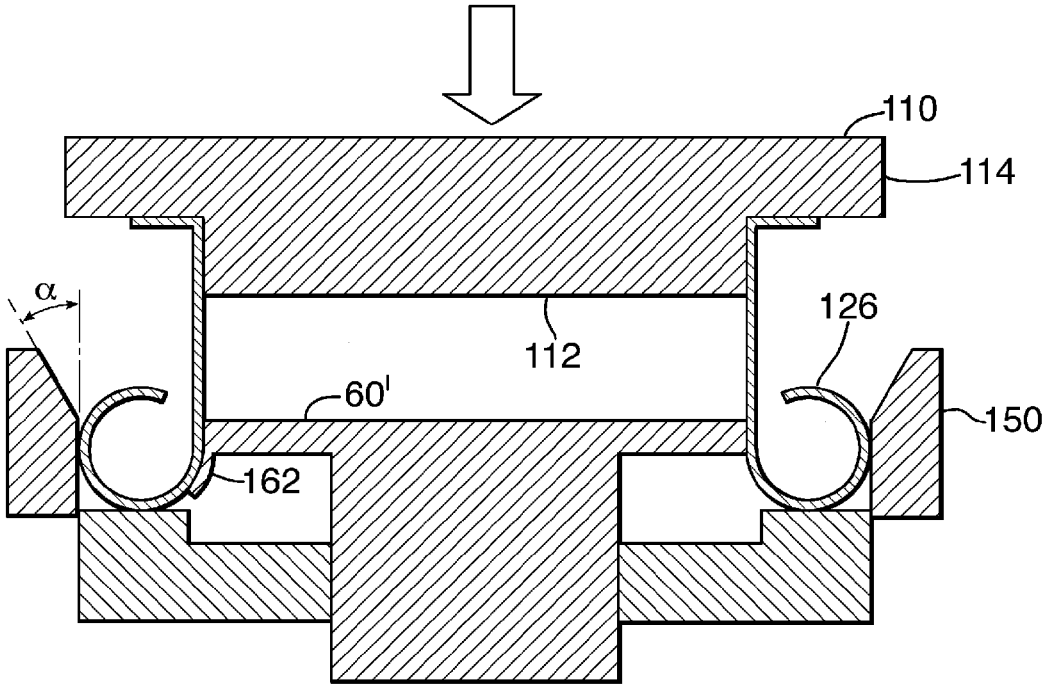
FIG. 13 is a schematic side section of the apparatus of FIG. 12, after forming the cup of lidding material.

In the position shown in FIG. 13, the punch 130 has entered the curled end of the can body 120, carrying the lidding material 160 with it. The lidding material 160 is drawn around the curl 126 until the sidewall of the lidding material cup 160' contacts the can body sidewall by at least 2 mm (typically between 2 and 5 mm).

In FIG. 13, the lidding material cup 160' extends into an integral tab 162 for ease of opening the can. This tab 162 could be folded over before, during or after forming, or alternatively could be a discrete tab which is positioned elsewhere on the lidding material, for example in the centre of the cup. In this case, the tab could be fixed to the cup after forming, or to the lidding material prior to the drawing operation.

After the lidding material cup 160' has been formed, the apparatus is passed through an induction coil with at least the base support 110, can body 120 and punch 130 remaining in position. Heat is induced in the can body 120 and lidding material 160 so that the polypropylene layer of the lidding material bonds to polypropylene in the lacquer to fix the lidding cup to the can body. Because the punch 130 and base support 110 are of polymeric, glass or ceramic material, no heat is induced in these components and the polypropylene will not adhere to them.

When the lidding material cup 160' has been bonded to the can sidewall, the punch 130 is withdrawn whilst the ejector 140 is held against the curl 126. A taper provided on the can and punch improves this removal; a taper of up to 90° or as in the specific examples of FIG. 9 will improve release of the can. The can body 120 which is closed by the cup 160' is then removed from the base support mandrel 112 for filling. In contrast with can bodies of the prior art, the can body 120 of the present invention is closed by the peelable membrane by the can manufacturer, and the filler can fill and close the base of the can with conventional machinery without the requirement to be able to fix a peelable membrane closure. This is clearly of great benefit to the filler.

The punch could be profiled and/or biased radially to ensure good contact over the bond region, particularly over the welded side seam. Alternative methods of biasing such as use of a conformed tool, springs, pneumatic or separate punch segments are possible.

Although the embodiment of FIGS. 12 and 13 has been described with the can body being used as the forming die and avoiding the need for an intermediate ring to which the membrane is fixed, it would clearly be possible (although not as economic) to use an intermediate ring as the forming die.

Figure 14:
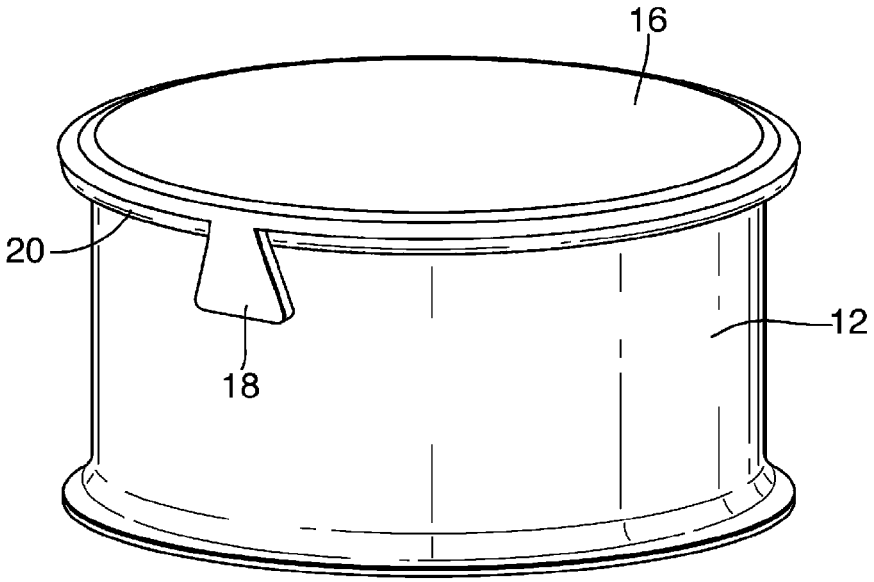
FIGS. 14 and 15 are views analogous to FIGS. 1 and 2, showing a fourth embodiment of the invention.
Figure 15:
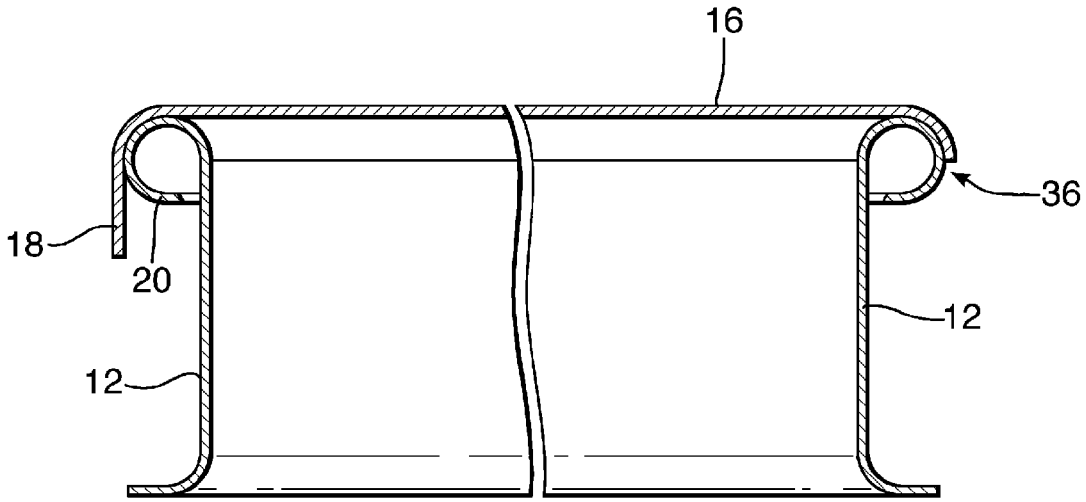

The fourth embodiment of FIGS. 14 and 15 differs from the previous ones in that the lid is sealed directly onto an outer surface of the can body 12. More precisely, it is sealed onto the toric curl 20 and, in particular, onto the outermost surface 36 of the latter, which is more or less perpendicular to the plane of the access opening 14.

Figure 16:
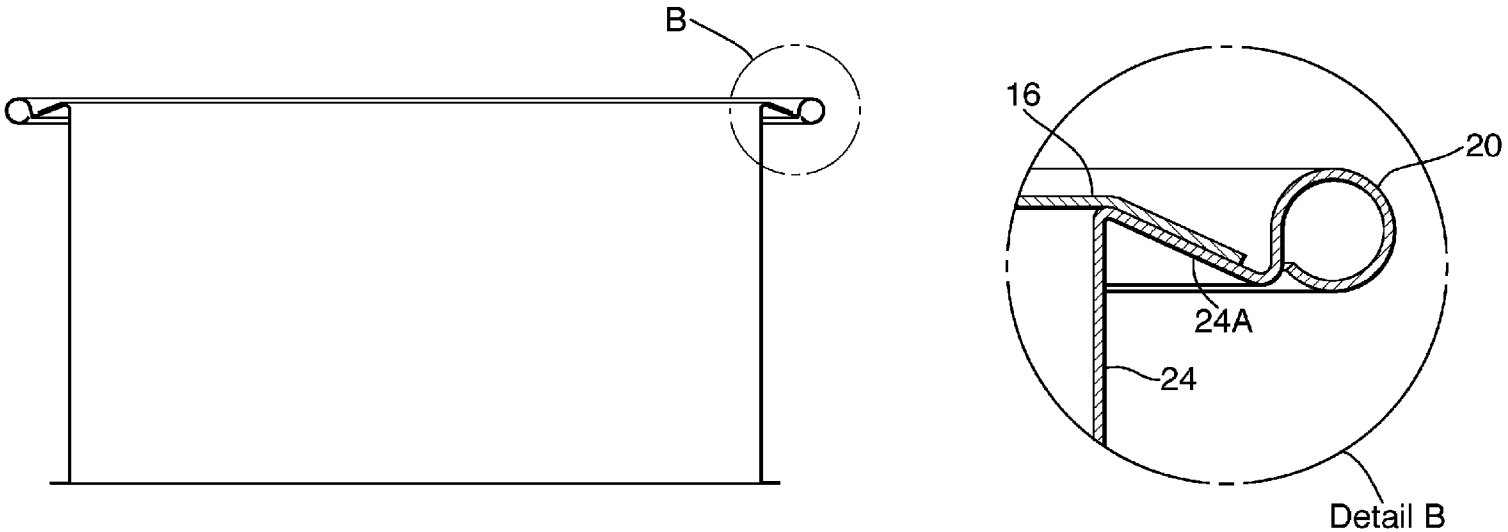
FIG. 16 is a side view of a further embodiment of can which has a barometric lid.

The final embodiment of FIG. 16 shows a container for a barometric lid, in which the sealing surface 24A angle is 115° to the vertical. Although this extends the sealing surface significantly beyond the can body diameter, this enables in-can pressure during processing of a food product in the container to be controlled. The bond of the sealing surface 24A of FIG. 16 only undergoes shear loading and thereby improves burst pressure performance significantly. The container of FIG. 16 can thus be used for processing of products in non-overpressure processes, such as using hydrostatic or reel and spiral retorts.

Thus in each embodiment, the lid is tightly sealed directly onto a surface of the can body. Where the sealing surface is parallel to the central axis of the can 10, the seal is broken by shearing which ensures a firm hold of the lid 16 on the can body. Where the sealing surface is inclined, opening forces are substantially reduced and opening is achieved without risk of tearing of the tab.

The invention claimed is:

1. A can for packaging food, the can comprising a metal can body having a sidewall that includes a vertically extending portion and an angled portion that extends from an upper end of the vertically extending portion, the angled portion being inclined upwards and outwards with respect to a can body center axis at an angle from 20° to about 60°, such that the angled portion defines a sealing surface, the vertically extending portion and the angled portion of the sidewall being a unitary one-piece structure; and a lid sealed to the can body on the sealing surface;

wherein the lid is formed of lidding material that is peelable in whole from the can body and comprises a multilayer structure with at least an aluminum layer having about 6 to about 90 microns thickness and a bond layer.

2. A can according to claim 1, wherein the bond layer is an external layer of polypropylene or modified polypropylene and the can body has an internal coating of polypropylene or lacquer including polypropylene dispersed in the lacquer.

3. A can according to claim 1, wherein the lid is fixed to the sealing surface of the can body by fusion of the lidding material or heat sealing.

4. A can according to claim 1, wherein the angle is about 30° to about 50°.

5. A can according to claim 1, further comprising a peripheral flange or curl extending from the angled portion, wherein the peripheral flange or curl bordering the angled portion at least partially defines the sealing surface.

6. A can according to claim 1, further comprising a tab that extends from the lid.

7. A can according to claim 6, wherein the lid and tab are integrally formed.

8. A can according to claim 1, wherein the can body is cylindrical.

9. A can according to claim 1, wherein the metal can body includes an outer circumferential curl and the angled portion extends from the outer circumferential curl to the vertically extending portion so as to define an access opening of the can body.

10. A can according to claim 1, wherein the angled portion extends directly from the upper end of the vertically extending portion.

11. A can for packaging food, the can comprising:

a metal can body having a vertically extending sidewall, the sidewall including an upper end that is inclined at an angle that is both upwards and outwards with respect to a can body center axis at an angle from 20° to about 60°, the upper end defining a sealing surface, the vertically extending sidewall including the upper end being a unitary one-piece structure; and a lid sealed to the can body on the sealing surface;

wherein the lid is formed of lidding material that is peelable in whole from the can body and comprises a multilayer structure.

12. A can according to claim 11, wherein the multilayer structure has at least an aluminum layer having about 6 to about 90 microns thickness.

13. A can according to claim 11, wherein the multilayer structure has a bond layer that is an external layer of polypropylene or modified polypropylene and the can body has an internal coating of polypropylene or lacquer including polypropylene dispersed in the lacquer.

14. A can according to claim 11, wherein the lid is fixed to the sealing surface of the can body by fusion of the lidding material or heat sealing.

15. A can according to claim 11, wherein the angle is about 30° to about 50°.

16. A can according to claim 11, wherein the sealing surface forms part of a peripheral flange or curl bordering an access opening.

17. A can according to claim 11, further comprising a tab that extends from the lid.

18. A can according to claim 17, wherein the lid and tab are integrally formed.

19. A can according to claim 11, wherein the can body is cylindrical.

20. A can according to claim 11, wherein the metal can body includes an outer circumferential curl and the angled portion extends from the outer circumferential curl to the vertically extending portion so as to define an access opening.

21. A can according to claim 11, wherein the upper end extends directly from a vertically extending portion of the vertically extending sidewall.

* * * * *